US007871031B2

(12) United States Patent
Liu et al.

(10) Patent No.: US 7,871,031 B2
(45) Date of Patent: Jan. 18, 2011

(54) DEVICE HAVING A LIFTABLE STRAP SUPPLY REEL

(75) Inventors: Chin-Chang Liu, Taichung (TW); Chi-Jan Su, Taipei (TW)

(73) Assignees: Tekpak Corporation, Taichung (TW); Transpak Equipment Corporation, Taipei (TW)

( * ) Notice: Subject to any disclaimer, the term of this patent is extended or adjusted under 35 U.S.C. 154(b) by 25 days.

(21) Appl. No.: 12/409,204

(22) Filed: Mar. 23, 2009

(65) Prior Publication Data

US 2010/0237182 A1 Sep. 23, 2010

(51) Int. Cl.
*B65H 75/44* (2006.01)

(52) U.S. Cl. ..... 242/399.2; 242/399; 242/597; 242/597.8; 248/125.2; 248/332

(58) Field of Classification Search ..... 242/398, 242/399, 399.1, 399.2, 597, 597.3, 597.8, 242/598.1, 598.4, 591; 248/125.2, 332
See application file for complete search history.

(56) References Cited

U.S. PATENT DOCUMENTS

| | | | | |
|---|---|---|---|---|
| 4,402,467 | A * | 9/1983 | Kontz | 242/597.8 |
| 4,509,415 | A * | 4/1985 | Stobb | 100/2 |
| 4,589,152 | A * | 5/1986 | Pakosh | 5/164.1 |
| 4,640,469 | A * | 2/1987 | Mackintosh | 242/399.1 |
| 6,105,909 | A * | 8/2000 | Wirth et al. | 248/125.2 |
| 6,612,793 | B2 * | 9/2003 | Coslovi et al. | 242/399 |
| 7,374,137 | B2 * | 5/2008 | Staney | 248/122.1 |

* cited by examiner

*Primary Examiner*—William A Rivera
(74) *Attorney, Agent, or Firm*—Ming Chow; Sinorica, LLC

(57) ABSTRACT

A device having a liftable strap supply reel includes a housing, a liftable mechanism and a pushing force generator. The liftable mechanism is pivoted on the housing and it has a first arm that is disposed with a rotatable strap supply reel. The liftable mechanism contains a home position, a critical position, and a lift-up position. When this lifting mechanism is positioned at the lift-up position, the pushing member generates a force to create a torque so that the strap supply reel stays at a height near a waist of a human. So, the strap supply reel can be lifted up to a height approximately near a waist of a human. It can be operated by one hand. In addition, it is convenient to repair or replace the strap.

5 Claims, 10 Drawing Sheets

DEVICE HAVING A LIFTABLE STRAP SUPPLY REEL

BACKGROUND OF THE INVENTION

1. Field of the Invention

The present invention relates to a device having a liftable strap supply reel, particularly to a strapping machine that has a liftable strap supply reel. In which, the strap supply reel can be lifted up to a height approximately near a waist of a human. It can be operated by one hand. In addition, it is convenient to repair or replace the strap.

2. Description of the Prior Art

Referring to FIGS. 11 and 12, the traditional strapping device 80 includes a machine 81 and a fixed strap supply reel 82. The machine 81 has an opening 811 and a door 812. The strap supply reel 82 is provided for winding on a strap 821. So, an object 90 can be strapped by this strap 821 via this strapping device 80.

The function of this strap supply reel 82 is to supply a strap 821 for strapping work. When the strap 821 is exhausted, the operator needs to take out the empty (or almost empty) strap supply reel 82 and then replace a new one. This task is called replacing work of the strap supply reel 82.

Because the strap supply reel 82 is fixed at a height near the knee of a human, the operator has to squat down for such replacing work. Therefore, it is quite inconvenient during the replacing work (or inspection, repair, etc.).

In addition, the strap 821 might be stuck, biased, jammed, or broken on the strap supply wheel 82. Under this condition, the operator must squat down and then open the door 812 for maintenance. However, it is dark inside the machine 81. Plus, it is not easy to stretch a hand in such a dark environment to repair or check it. It is not comfortable for long-time squatting down. Sometimes, the operator needs to take out the strap supply reel 82 for inspection. Anyway, such maintenance work is very inconvenient.

SUMMARY OF THE INVENTION

The objects of the present invention are to provide a device having a liftable strap supply reel. In which, the strap supply reel can be lifted up to a height approximately near a waist of a human. It can be operated by one hand. Plus, it is convenient to repair or replace the strap. Hence, it can solve the conventional problems such as the operator must squat down for the maintenance work in a dark environment inside the machine and the replacing work is extremely inconvenient, etc.

In order to achieve above-mentioned objects, this invention is provided. A device having a liftable strap supply reel comprises:

a housing having an inner space, an opening, a first pivoting portion and a second pivoting portion;

a liftable mechanism including a rotating shaft, a first arm, a second arm and a handle; the rotating shaft being pivoted on the first pivoting portion and being able to rotate within a preset range; the first arm having a first length and being disposed with a rotatable strap supply reel for storing a strap winding thereon; the second arm having a controlling end and having a second length; the second length being shorter than the first length;

a pushing force generator having a pushing member and a pushing body, the pushing member connecting with the controlling end, the pushing body connecting with the second pivoting portion;

The liftable mechanism containing a home position, a critical position and a lift-up position; when the liftable mechanism being positioned at the home position, the pushing member generating a force on the second arm so as to create a torque to a predetermined direction and causes the feeding roller staying in the inner space; when the lifting mechanism being positioned at the critical position, the pushing member generating no force on the second arm so as to create zero torque; when the lifting mechanism being positioned at the lift-up position, the pushing member generating another force on the second arm so as to create another torque opposite to the predetermined direction, so that the second arm rotates and lifts up and also causes the strap supply reel moving outside of the inner space and stays at a height approximately near a waist of a human.

DETAILED DESCRIPTION OF THE PREFERRED EMBODIMENT

Figure 1:
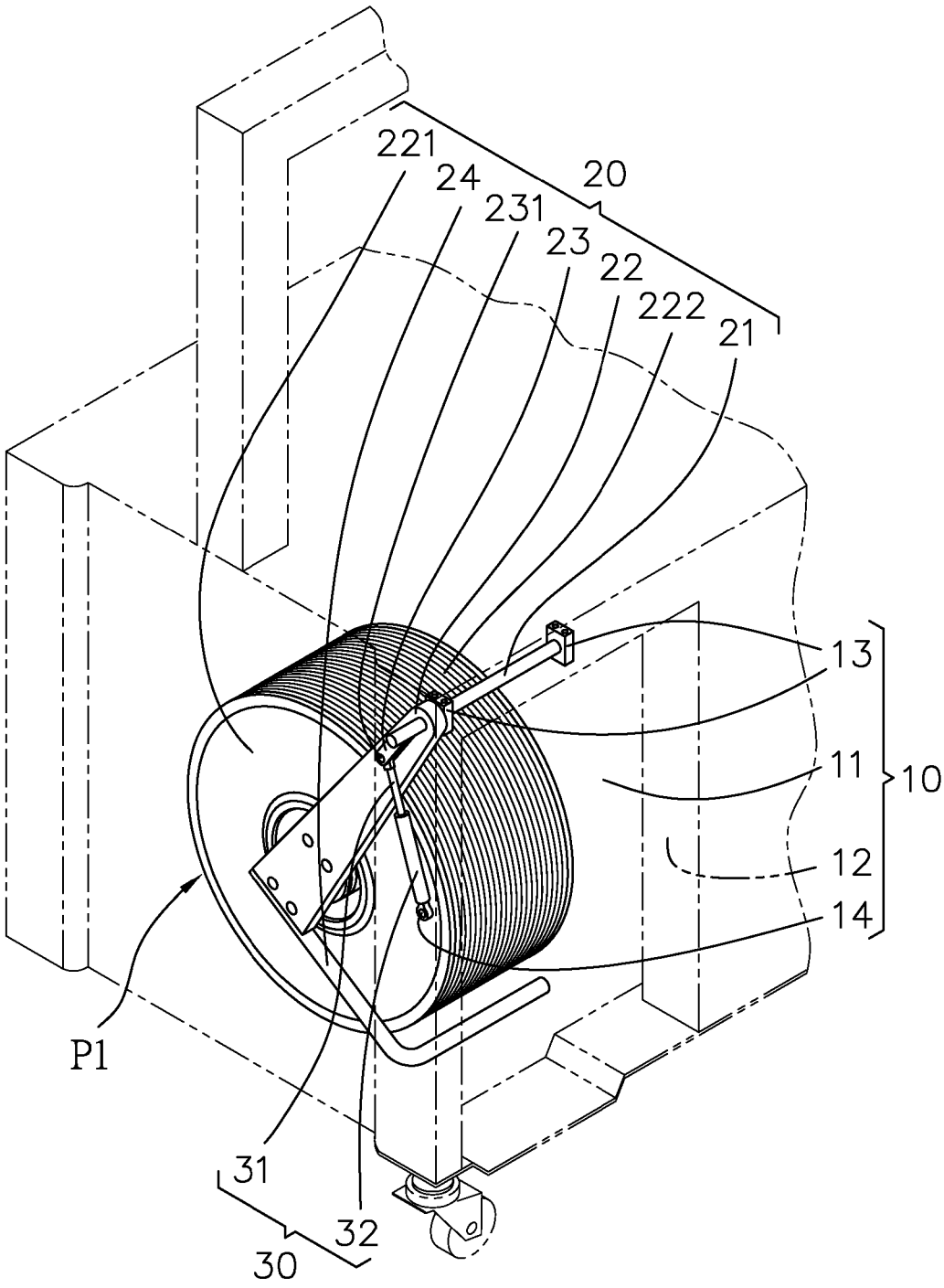
FIG. 1 is a perspective view of the first preferred embodiment of the present invention when the liftable mechanism is positioned at the home position.
Figure 2:
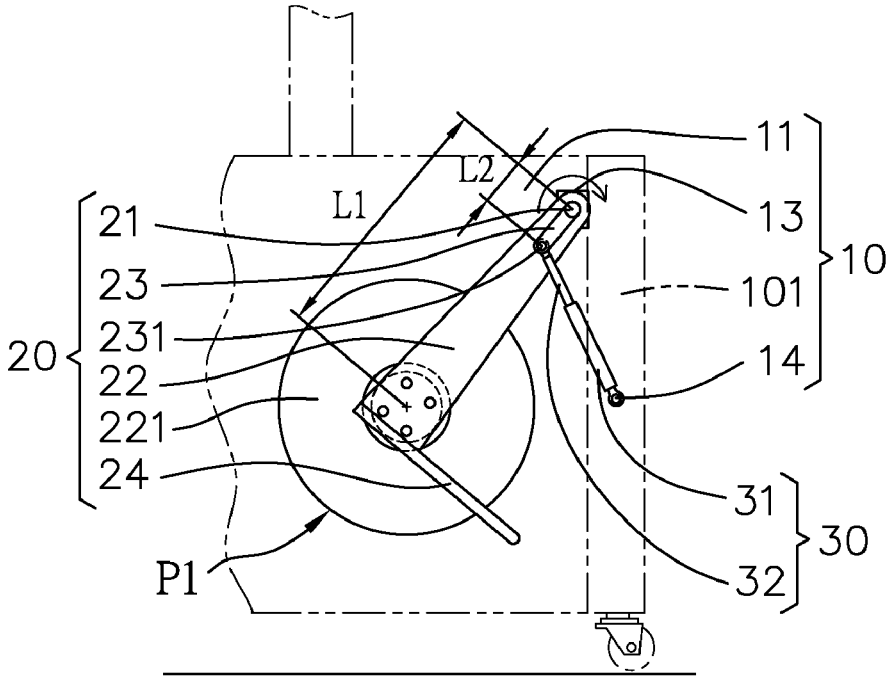
FIG. 2 shows the liftable mechanism that is positioned at the home position.

The present invention is a device having a liftable strap supply reel. FIGS. 1 and 2 show the first preferred embodiment of this invention. It mainly includes a housing 10, a liftable mechanism 20, and a pushing force generator 30.

Concerning this housing 10, it has an inner space 11, an opening 12, a first pivoting portion 13 and a second pivoting portion 14.

With regard to the liftable mechanism 20, it includes a rotating shaft 21, a first arm 22, a second arm 23, and a handle 24. The rotating shaft 21 is pivoted on the first pivoting portion 13 and is able to rotate within a preset range. Furthermore, the first arm 22 has a first length L1 and is disposed with a rotatable strap supply reel 221 that can store a strap 222 winding thereon. The second arm 23 has a controlling end 231 and has a second length L2. The second length L2 is shorter than the first length L1.

About this pushing force generator 30 (such as a pneumatic cylinder or the like), it has a pushing member 31 and a pushing body 32. The pushing member 31 connects with the controlling end 231. The pushing body 32 connects with the second pivoting portion 14.

Figure 3:
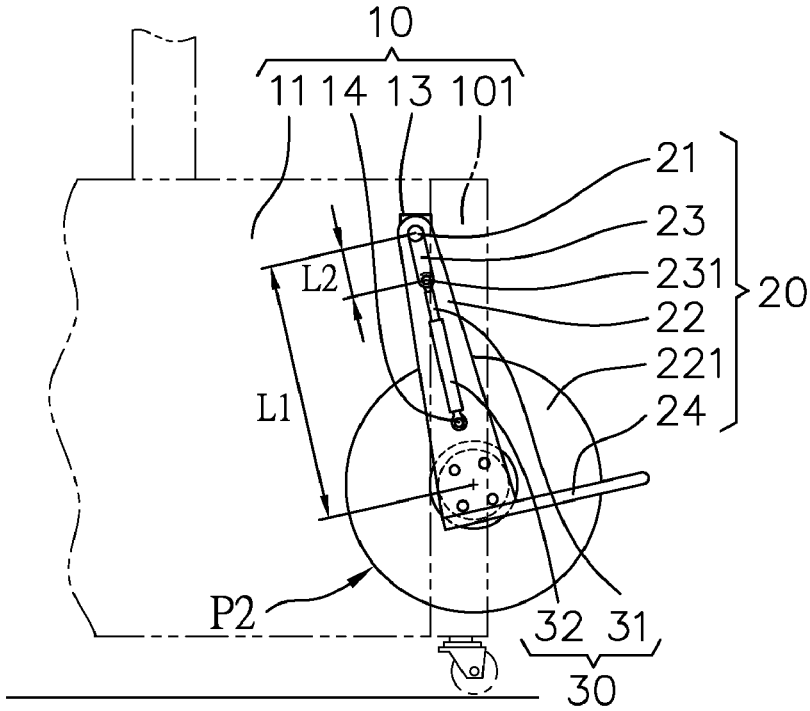
FIG. 3 shows the liftable mechanism that is positioned at the critical position.
Figure 4:
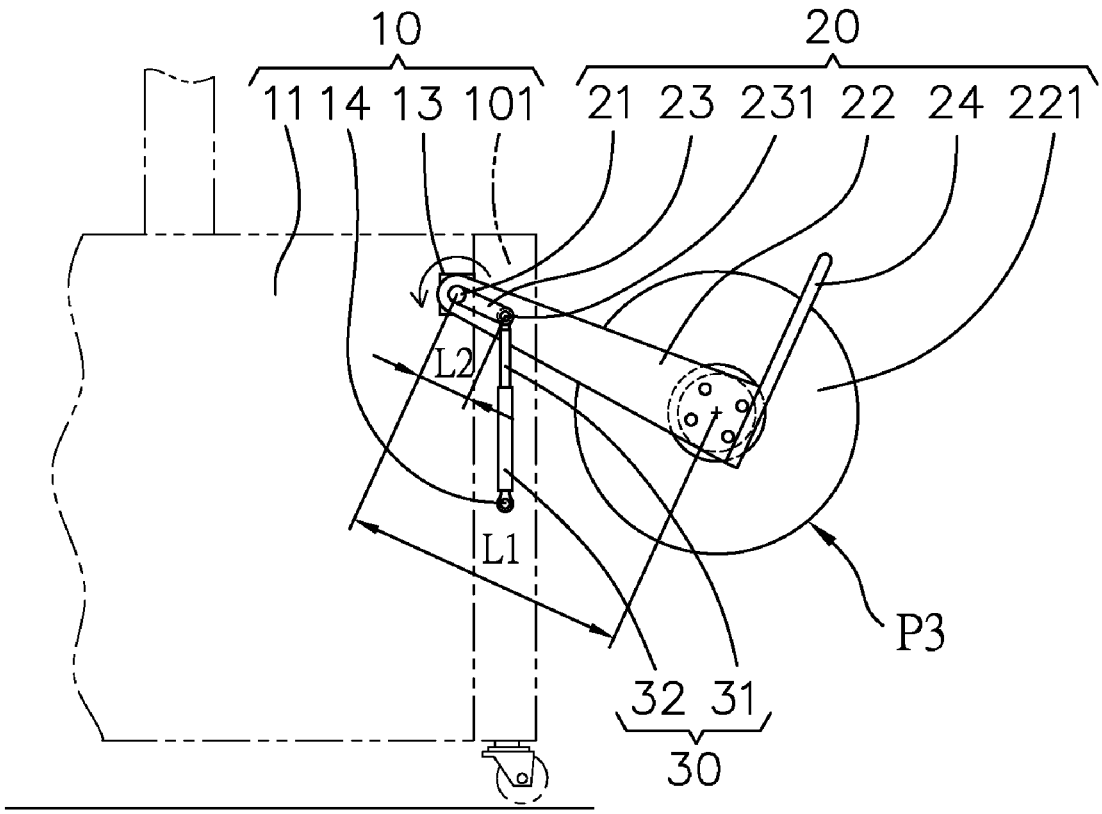
FIG. 4 shows the liftable mechanism that is positioned at the lift-up position.
Figure 5:
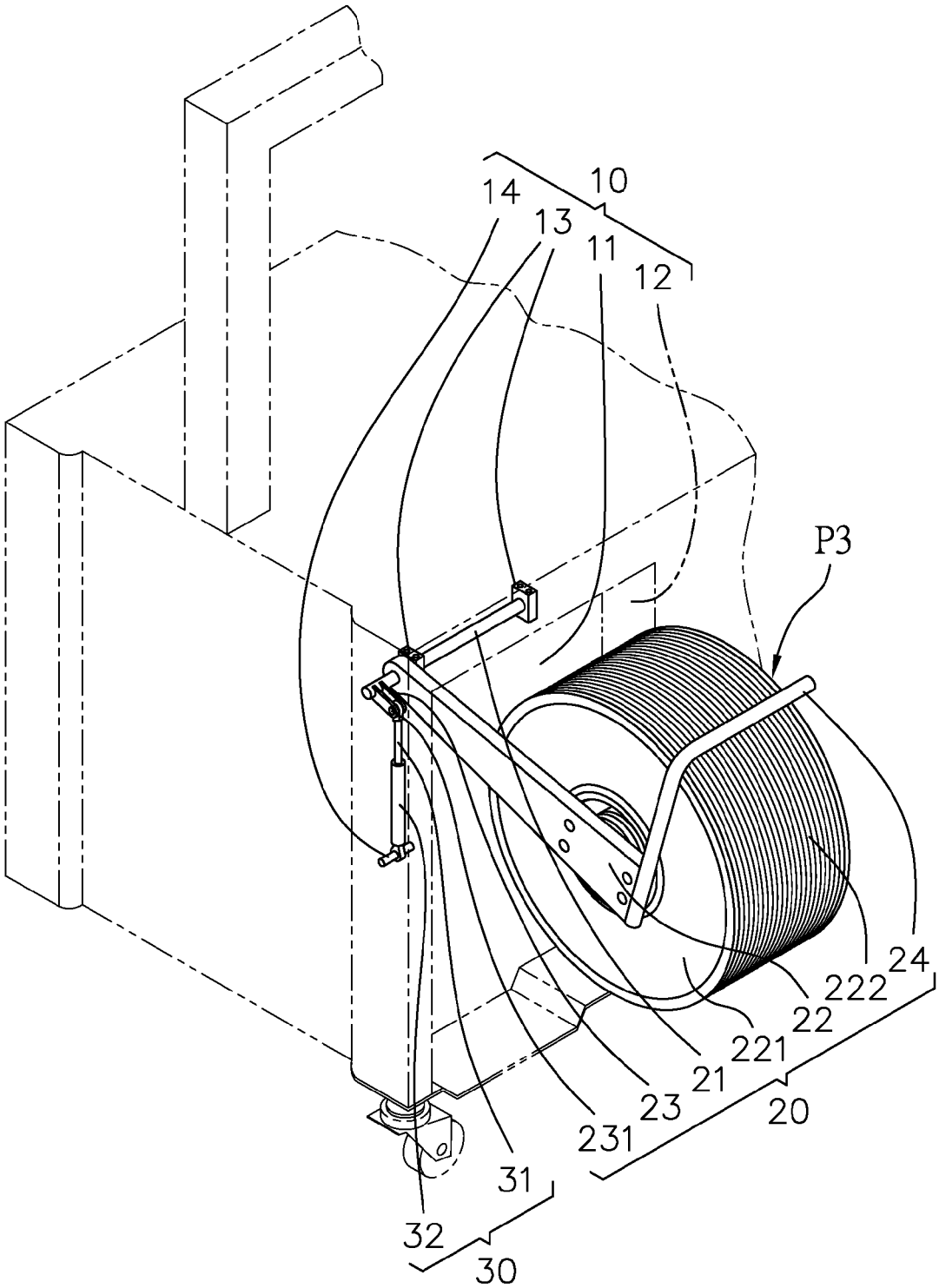
FIG. 5 is a perspective view showing the liftable mechanism that is positioned at the lift-up position.
Figure 6:
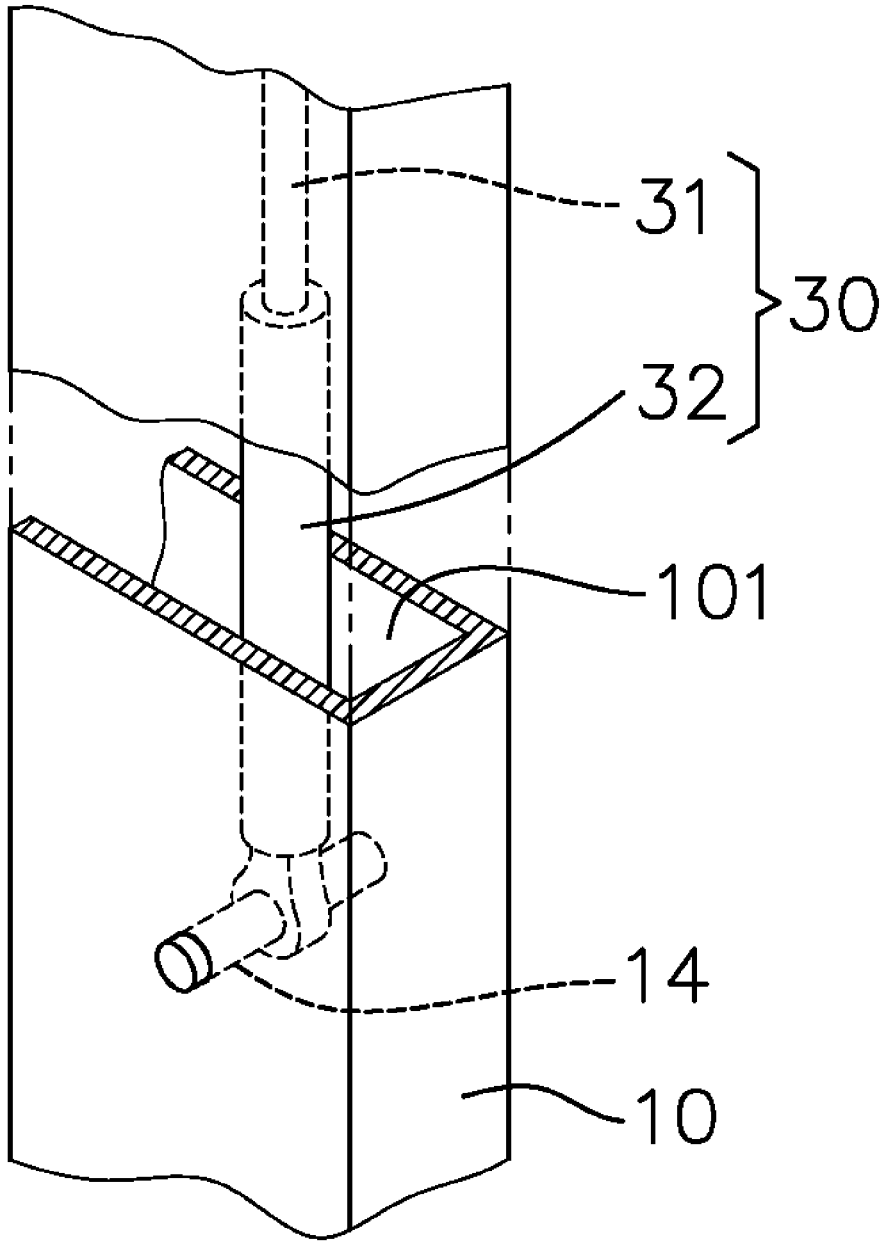
FIG. 6 is an enlarged view illustrating a selected portion in FIG. 5.

The liftable mechanism 20 contains a home position P1, a critical position P2 (as illustrated in FIG. 3), and a lift-up position P3 (as exhibited in FIG. 4). When this liftable mechanism 20 is positioned at the home position P1 (referring to FIG. 2), the pushing member 31 generates a force on the second arm 23 so as to create a torque to a predetermined direction (for example, clockwise in FIG. 2) and causes the strap supply reel 221 staying in the inner space 11. When the lifting mechanism 20 is positioned at the critical position P2 (see FIG. 3), the pushing member 31 generates no force on the second arm 23 so as to create zero torque. Moreover, when this lifting mechanism 20 is positioned at the lift-up position P3 (see FIG. 4), the pushing member 31 generates another force on the second arm 23 so as to create another torque opposite to the predetermined direction (for example, counterclockwise in FIG. 4), so that this second arm 23 rotates and lifts up. Meanwhile, it also causes the strap supply reel 221 moving outside of the inner space 11 (referring to FIG. 5) and stays at a height approximately near a waist of a human (such as a strapping machine operator or a worker).

Figure 10:
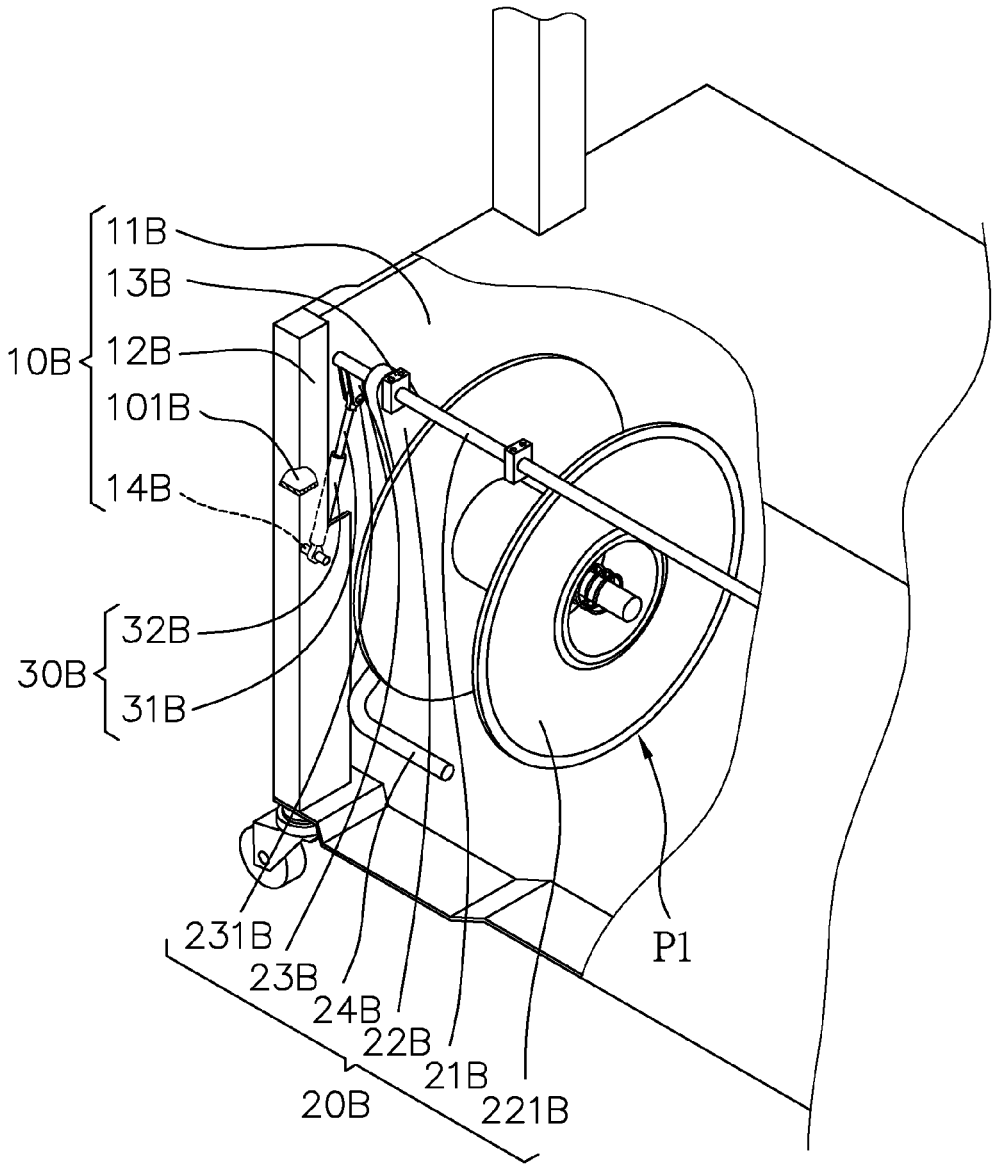
FIG. 10 is a perspective view of the third preferred embodiment of the present invention when the liftable mechanism is positioned at the home position.
Figure 11:
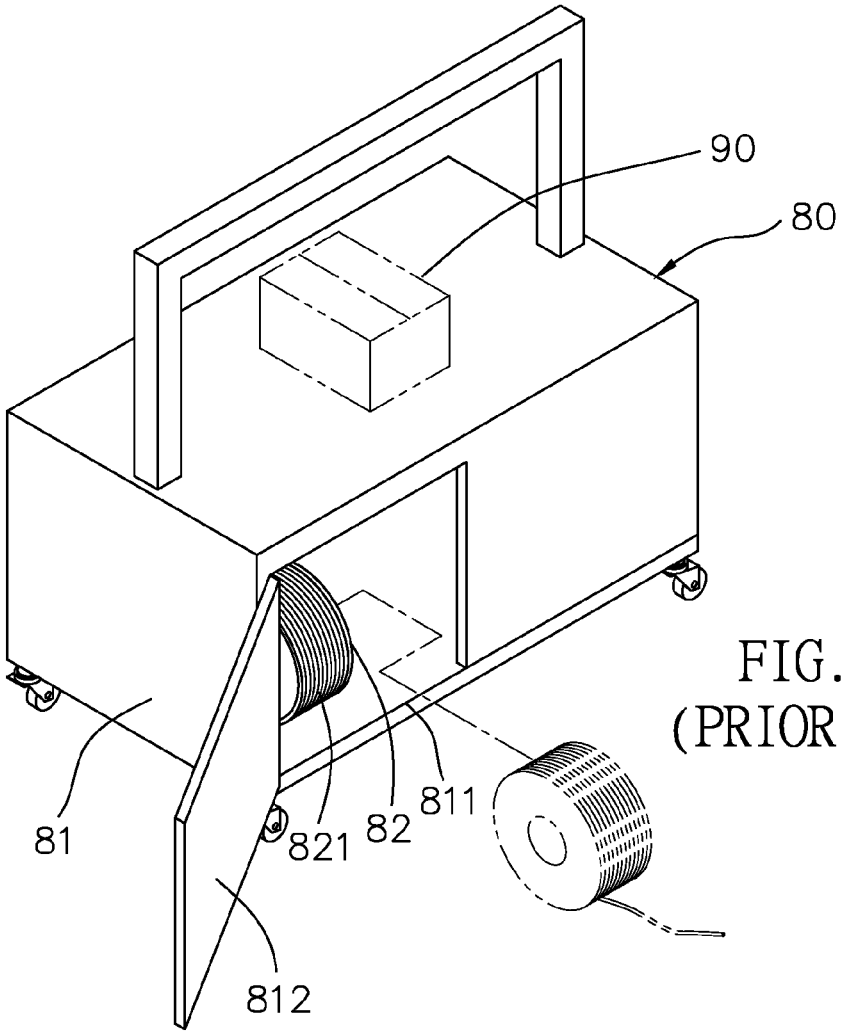
FIG.11 (PRIOR ART)
FIG. 11 is a perspective view of a traditional strapping device.
Figure 12:
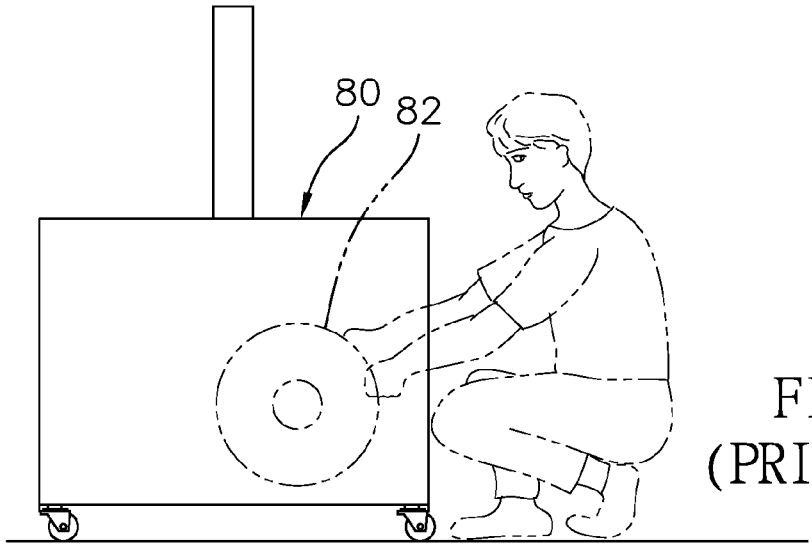
FIG.12 (PRIOR ART)
FIG. 12 shows that the operator must squat down for maintenance or replacing work for a tradition strapping device.

Practically, the first pivoting portion 13 can be formed as a pair of pivoting protrusions (as shown in FIG. 1), pivoting seats (labeled as 13B as illustrated in FIG. 10; the third preferred embodiment), or bearings (not shown).

The first arm 22 extends from the rotating shaft 21 with the first length L1.

Figure 7:
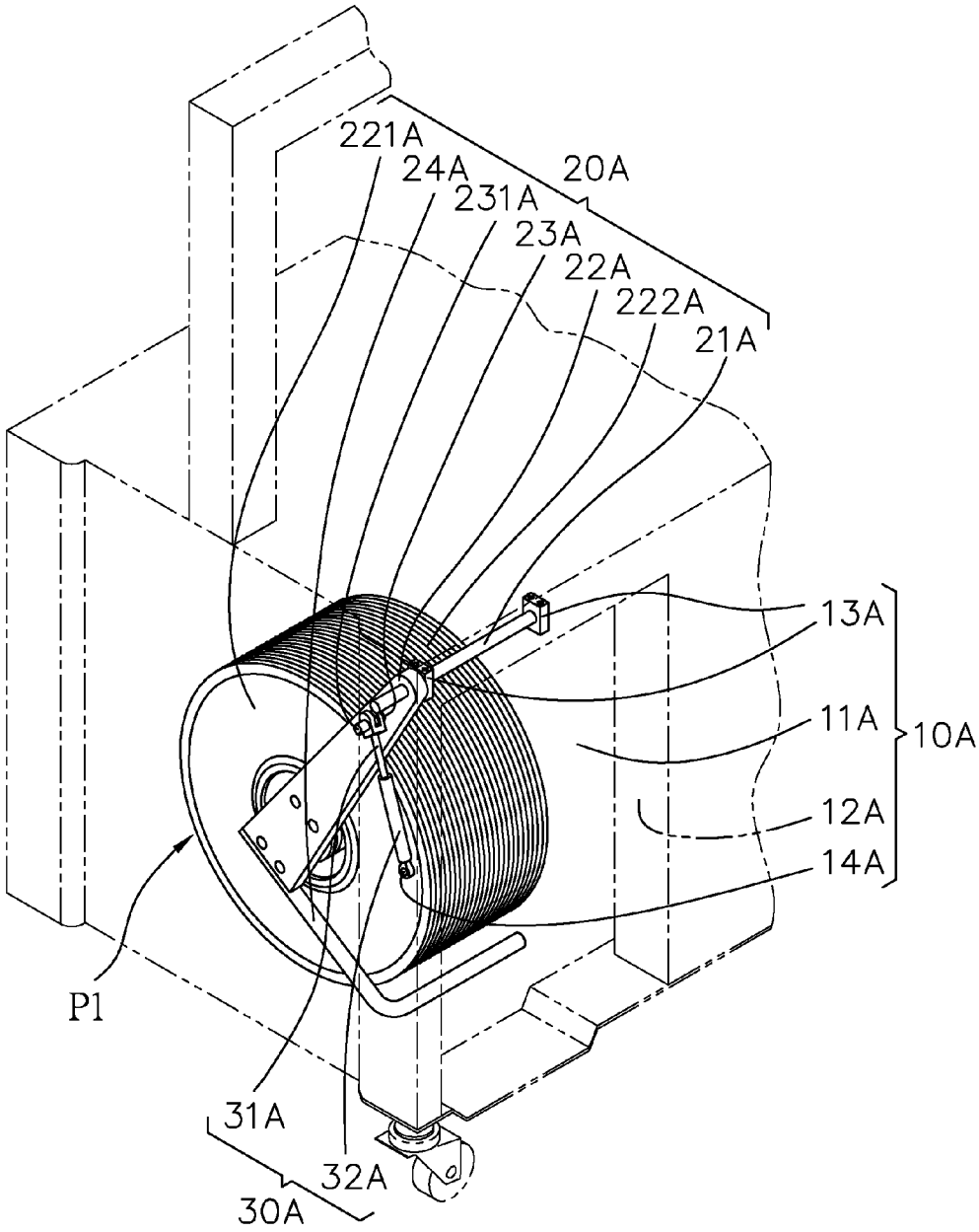
FIG. 7 is a perspective view of the second preferred embodiment of the present invention when the liftable mechanism is positioned at the home position.
Figure 8:
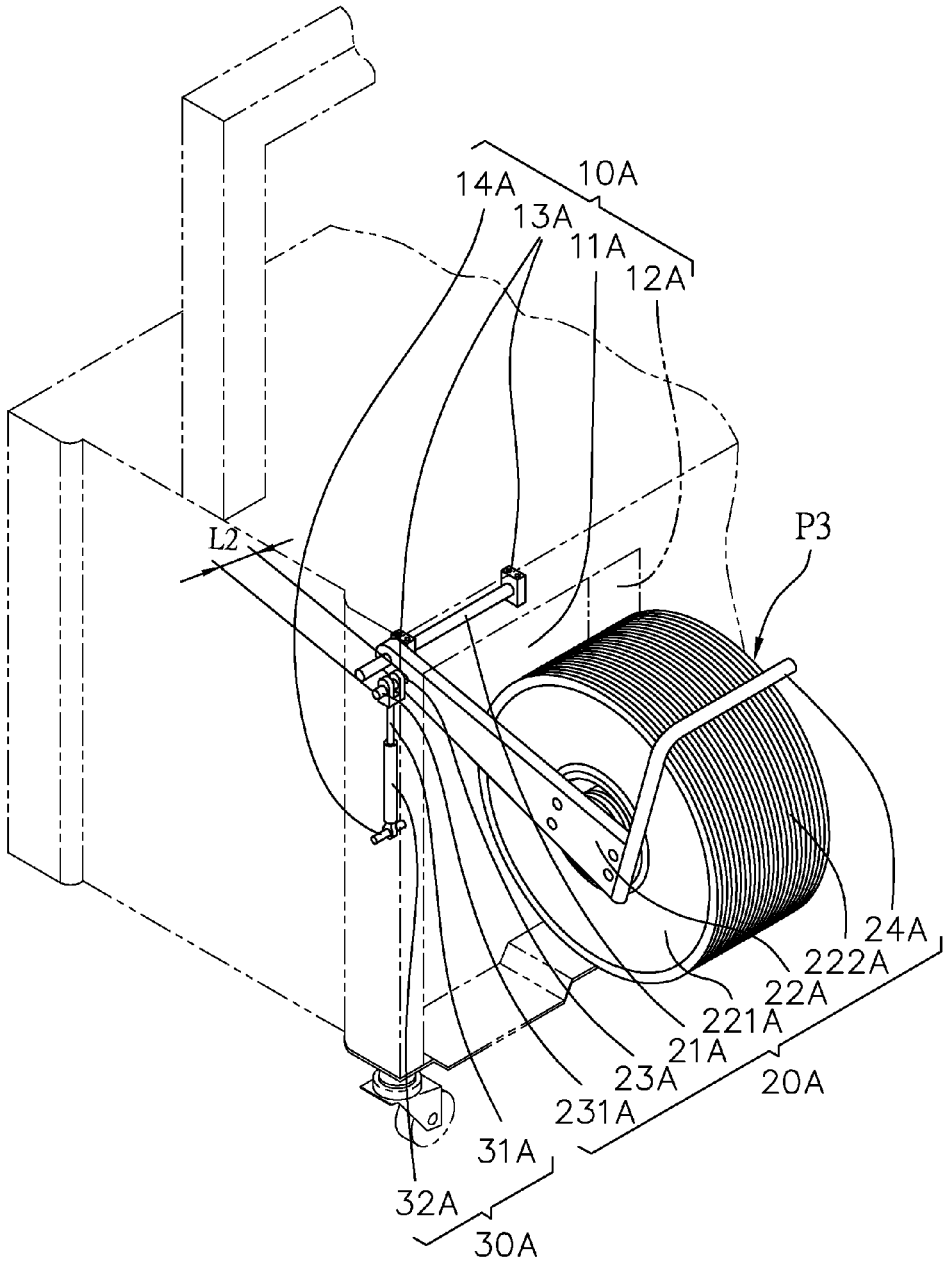
FIG. 8 is a perspective view of the second preferred embodiment of the present invention when the liftable mechanism is positioned at the lift-up position.
Figure 9:
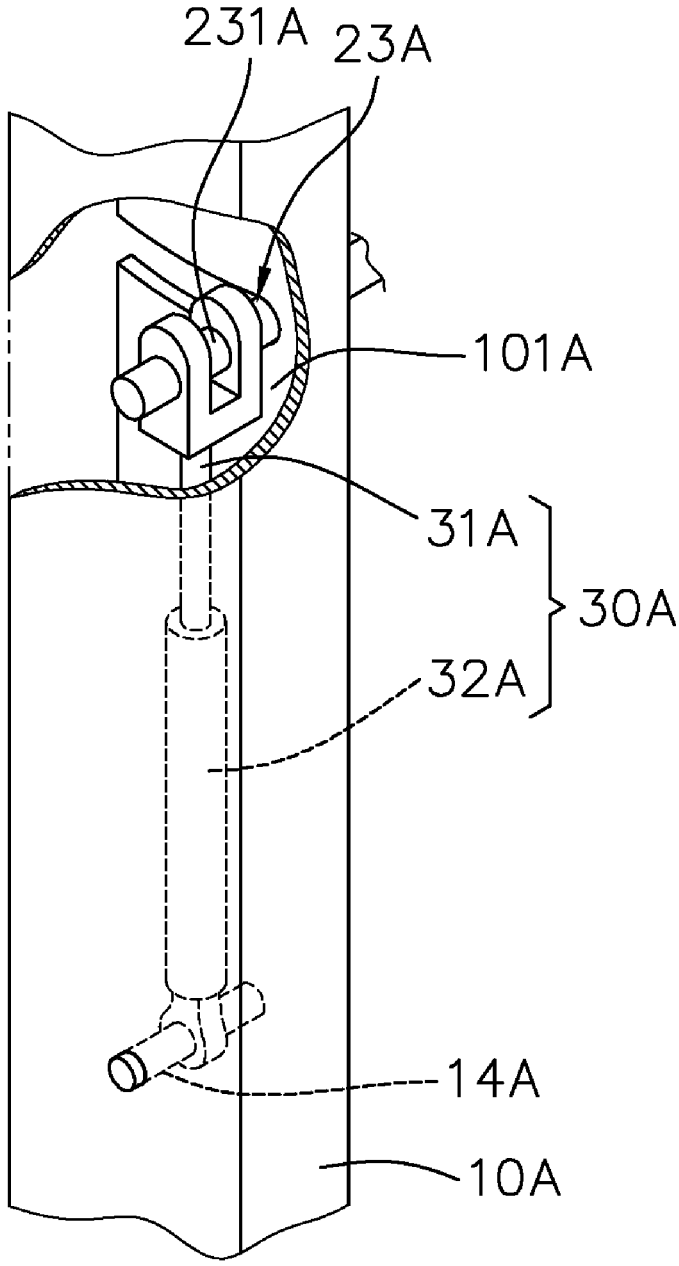
FIG. 9 is an enlarged view illustrating a selected portion in FIG. 8.

The controlling end 231 of the second arm 23 extends from the rotating shaft 21 with the second length L2 (see FIG. 1) or extends from the first arm 22A with the second length L2 (as illustrated in FIGS. 7 to 9; the second preferred embodiment).

The handle 24 can be extended from the first arm 22.

In addition, it is optional that this housing 10 further includes a recessed portion 101. When this liftable mechanism 20 is positioned at the home position P1, the pushing member 31 is hidden in this recessed portion 101.

Furthermore, with regard to the second embodiment shown in FIGS. 7 to 9, the housing 10A also has an inner space 11A, an opening 12A, a first pivoting portion 13A, a second pivoting portion 14A and a recessed portion 101A. The liftable mechanism 20A includes a rotating shaft 21A, a first arm 22A, a second arm 23A, a handle 24A, a rotatable strap supply reel 221A that can store a strap 222A, and a controlling end 231A. Plus, the pushing force generator 30A (such as a pneumatic cylinder or the like) has a pushing member 31A and a pushing body 32A. Basically, the elements and function of the second embodiment are substantially as same as the first one, except the controlling end 231A extends from the first arm 22A.

Besides, with regard to the second embodiment shown in FIG. 10, the housing 10B also has an inner space 11B, an opening 12B, a pair of first pivoting portions 13B, a second pivoting portion 14B and a recessed portion 101B. The liftable mechanism 20B includes a rotating shaft 21B, a first arm 22B, a second arm 23B, a handle 24B, a rotatable strap supply reel 221B, and a controlling end 231B. Plus, the pushing force generator 30B (such as a pneumatic cylinder or the like) has a pushing member 31B and a pushing body 32B. Basically, the s and function of the third embodiment are substantially as same as the first one, except the shape of rotating shaft 21B and the first pivoting portions 13B.

The operation of this invention can be described as follows.

As shown in FIGS. 1 and 2, when the liftable mechanism 20 is positioned at the home position P1, the pushing member 31 pushes the second arm 23 in (inside the housing 10). The strap 222 (such as the strap of a strapping machine) on the strap supply reel 221 can be supplied and strap around an object (such as a box) for strapping work (the strapping work is a prior art; so no more detailed description is given here). If the strap 222 is broken, jammed, exhausted, or stuck somewhere (so the strap supply reel 221 cannot rotate), the user usually wants to inspect the strap supply reel 221 to know what happens. So, the user can hold the handle 24 and pull it out. When the user pulls out the handle 24, this user also makes the first arm 22 and the rotating shaft 21 rotating (about the first pivoting portion 13) at the same moment. Meanwhile, the pushing body 32 rotates about the second pivoting portion 14. The second arm 23 presses on the pushing member 31 (making the pushing member 31 retreats). Then, the liftable mechanism 20 moves from the home position P1 to the critical position P2 (see FIG. 3).

If the user keeps pulling the handle 24 out, the liftable mechanism 20 will move from the critical position P2 to the lift-up position P3 (see FIG. 4). During this process, the pushing member 31 pushes the second arm 23 and makes it rotates. Hence, it also makes the first arm 21 which is pivoted on the rotating shaft 21 rotates (see FIG. 4). At the same time, the strap supply reel 221 moves outward and upward. Therefore, this strap supply reel 221 can be easily and automatically lifted up. Finally, the liftable mechanism 20 stays at the lift-up position P3 that is kept at a height approximately near a waist of a human (such as a strapping machine operator or a worker). Under this circumstance, it is very convenient to inspect, fix or replace the strap 222 as well as strap supply reel 221.

If the user wants to let the strap supply reel 221 return its home position P1 (in the inner space 11 of the housing 10), this user just operates in the opposite ways mentioned above.

Therefore, the advantages and functions of this invention can be summarized as follows.

[1] The strap supply reel can be lifted up to a height approximately near a waist of a human. In this invention, the strap supply reel is disposed on the liftable mechanism, so the strap supply reel can be lift up to a height approximately near a waist of a human. The user does not need to bend down or squat down during a maintenance work (such as inspect, fix or replace the strap as well as strap supply reel).

[2] It can be operated by one hand. The handle is mounted on the liftable mechanism. Plus, there is a pushing force generator disposed between the housing and the liftable mechanism. The pushing force will make the liftable mechanism moving inward (having a better positioning effect) or make the liftable mechanism moving outward (allowing it lifts up automatically and will not drop).

[3] It is convenient to repair or replace the strap. Because this strap supply reel can be moved to a position totally outside the housing, the user can inspect the strap or the strap supply reel clearly under a bright environment. Under this condition, the related repairing or replacing works can be easily done. The user will not touch the electric wires or mess up the other parts inside the housing. Besides, it can significantly reduce the possibility that the hand of the user is injured in such a dark environment inside the housing.

While this invention has been particularly shown and described with references to the preferred embodiments thereof, it will be understood by those skilled in the art that various changes or modifications can be made therein without departing from the scope of the invention by the appended claims.

What is claimed is:

1. A device having a liftable strap supply reel comprising: a housing having an inner space, an opening, a first pivoting portion and a second pivoting portion;

a liftable mechanism including a rotating shaft, a first arm, a second arm and a handle; said rotating shaft being pivoted on said first pivoting portion and being able to rotate within a preset range; said first arm having a first length and being disposed with a rotatable strap supply reel for storing a strap winding thereon; said second arm having a controlling end and having a second length; said second length being shorter than said first length;

a pushing force generator having a pushing member and a pushing body, said pushing member connecting with said controlling end, said pushing body connecting with said second pivoting portion;

said liftable mechanism containing a home position, a critical position and a lift-up position; when said liftable mechanism being positioned at said home position, said pushing member generating a force on said second arm so as to create a torque to a predetermined direction and cause a feeding roller staying in said inner space; when said lifting mechanism being positioned at said critical position, said pushing member generating no force on said second arm so as to create zero torque; when said lifting mechanism being positioned at said lift-up position, said pushing member generating another force on said second arm so as to create another torque opposite to said predetermined direction, so that said second arm rotates and lifts up and also causes said strap supply reel moving outside of said inner space and stays at a height approximately near a waist of a human.

2. The device having a liftable strap supply reel comprising as claimed in claim 1, wherein said first pivoting portion is a pair of pivoting protrusions, pivoting seats.

3. The device having a liftable strap supply reel comprising as claimed in claim 1, wherein:

said first arm extends from said rotating shaft with the first length;

said controlling end of the second arm extends from said rotating shaft with the second length; and said handle extends from said first arm.

4. The device having a liftable strap supply reel comprising as claimed in claim 1, wherein said first arm being extends from said rotating shaft with the first length;

said controlling end of the second arm extends from said first arm with the second length; and said handle extends from said first arm.

5. The device having a liftable strap supply reel comprising as claimed in claim 1, wherein said housing further includes a recessed portion; when said liftable mechanism being positioned at said home position, said pushing member being hidden in said recessed position.

* * * * *